US006832826B2

(12) United States Patent
Dunand

(10) Patent No.: US 6,832,826 B2
(45) Date of Patent: Dec. 21, 2004

(54) INK-DROP GENERATOR AND PRINTER ASSEMBLY

(75) Inventor: Alain Dunand, Grenoble (FR)

(73) Assignee: Imaje, Bourg-les-Valence (FR)

( * ) Notice: Subject to any disclaimer, the term of this patent is extended or adjusted under 35 U.S.C. 154(b) by 249 days.

(21) Appl. No.: 09/832,530

(22) Filed: Apr. 11, 2001

(65) Prior Publication Data

US 2001/0035890 A1 Nov. 1, 2001

(30) Foreign Application Priority Data

Apr. 12, 2000 (FR) ..... 00 04684

(51) Int. Cl.[7] ..... B41J 2/015
(52) U.S. Cl. ..... 347/20; 347/46
(58) Field of Search ..... 347/20, 46, 68–71

(56) References Cited

U.S. PATENT DOCUMENTS 4,138,687 A * 2/1979 Cha et al. ..... 346/75
4,303,927 A 12/1981 Tsao
4,370,662 A 1/1983 Hou et al.
5,457,484 A 10/1995 Regnault et al.
5,666,677 A 9/1997 Crawford et al.
6,003,971 A 12/1999 Hanks et al.

FOREIGN PATENT DOCUMENTS

EP 0 449 929 B1 7/1995
EP 0 869 001 A3 7/1998

OTHER PUBLICATIONS

WO98/51503, A Droplet Generator For A Continuous Stream Ink Jet Print Head, Apr. 1998.

* cited by examiner

*Primary Examiner*—Lamson Nguyen
*Assistant Examiner*—Ly T Tran
(74) *Attorney, Agent, or Firm*—Pearne & Gordon LLP

(57) ABSTRACT

An ink-drop generator (33) of an ink-jet printer is characterized in that a resonating ink cavity (6) from which the ink is supplied via a nozzle plate (39) onto a printing substrate has its lateral walls (7, 8, 9, 10) perpendicular to the nozzle plate (39). The end-nozzles may thus be positioned adjacent to the walls (9, 10) of the cavity (6).

20 Claims, 9 Drawing Sheets

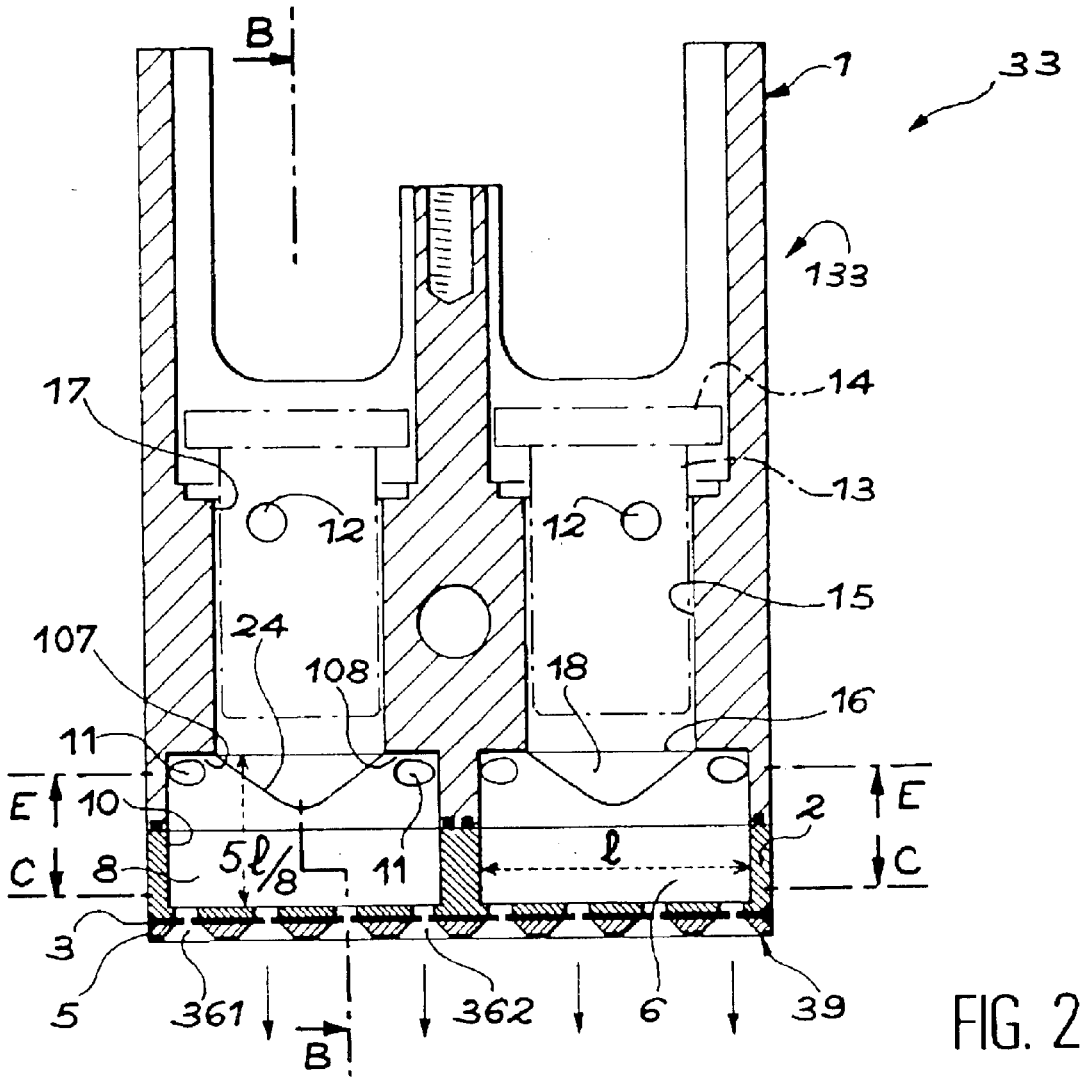
FIG. 2
FIG. 3
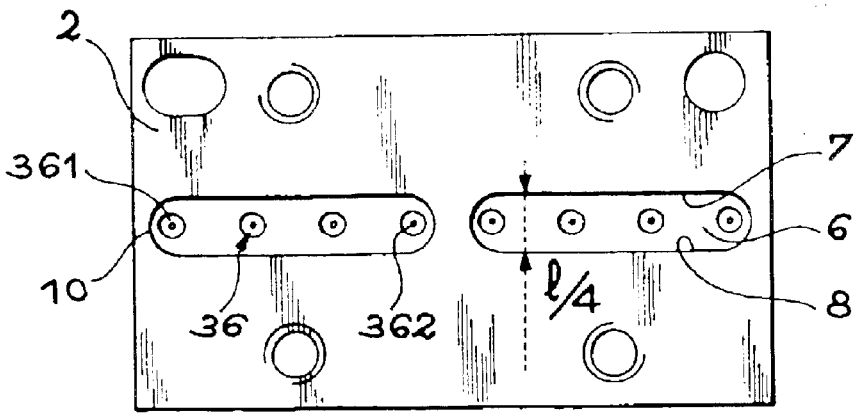

INK-DROP GENERATOR AND PRINTER ASSEMBLY

FIELD OF THE INVENTION

The present invention relates to the field of ink-drop generators used in inkjet printers. It also relates to a print head and a printer using said ink-drop generator.

BACKGROUND ART

The principle of the inkjet printer is now well-known and has been described, for example, in the American patent No. U.S. Pat. No. 3,373,437 granted to Richard G. Sweet. In this type of printer an ink-drop generator produces drops of ink that are electrically charged then deflected or not deflected by deflecting electrodes to print or not print a downstream substrate. The technology of deflected continuous jets has been widely used in industrial marking applications where inks incorporate volatile solvents and/or pigments for mediums that are difficult to mark where the atmosphere is rendered difficult due to the presence of dust and a variable temperature. The printed widths are small and the outputs are high. A generator of small drops, such as that described in French patent No. FR 2 653 063 (granted to the present applicant), generally comprises a single inkjet created from a pressurized inkjet cavity that has a jet nozzle on one of its surfaces.

The ink cavity also has an elongated cylindrical transducer on a surface opposite that which comprises the nozzle. Said transducer vibrates at a high frequency according to a longitudinal mode and constantly fragments the jet into regular, identical, equidistant droplets. The assembly consisting of the ink cavity, transducer and nozzle plate is called an ink-drop generator. The ink-drop generator is associated with charge electrodes, deflecting electrodes and possibly an ink collector to constitute a print head. One or more print heads can be mounted on the same printer. One or more ink-drop generators can also be assembled to constitute a single print head. For instance, patent application Ser. No. 2 653 063 referred to above discloses a print head comprising at least two modulation bodies and therefore at least two nozzles equipped with means for adjusting each jet and a single ink-collector module with a single pipe for returning the ink to the common circuit. This type of print head offers the possibility of printing large characters at a higher rate than that provided by a head with only one jet. The detailed embodiment of the invention described below also comprises two modulation bodies, which are also called acoustic-wave generators, shakers, resonators or transducers in documents concerning this technology, but each body actuates several inkjets.

In the description of the prior art contained in European patent EP 0 449 929 B1 it is recalled in col. 1, lines 24–25 and 54–58 that, for chambers comprising several jets, each nozzle is positioned facing either its own acoustic vibration generator or a section of a longitudinal acoustic generator whose measurements extend parallel to the line formed by the jet-nozzle assembly. The acoustic generator is supplied with sufficient power to print a vibration with ink in a direction parallel to the jet. The patent then points out in col. 2, lines 1–8 that this configuration of the vibration generator relative to the nozzle plate is not indispensable provided certain conditions of resonance are met. If the conditions of resonance are complied with a single acoustic generator can stimulate the ink passing through a line of nozzles or part of a line of nozzles that has a length considerably greater parallel to the line of nozzles than the size of the acoustic generator in the same direction, for example 5 to 10 times larger. The condition to be complied with is that the vibrating body vibrates virtually only in a longitudinal mode and at a resonance frequency that differs by −10% of the excitation frequency of the natural resonance vibrations in the ink of the cavity between the end of the body and the nozzle plate, the width of the body being smaller than the length of the series of nozzles or the part of the series of nozzles associated with said body.

In this patent the lateral walls of the ink chamber have a cross-section perpendicular to the line of nozzles disposed in a V shape. The tip of the V is turned towards the line of nozzles. The section of chamber comprising the V-shaped walls may be changed to enable the height of the V to be varied depending on the density of the ink and therefore the speed of the sound in the ink used.

Patent application WO 98 51503 also describes an ink-drop generator for an inkjet printer with the following characteristics: the lateral walls of a cavity containing the ink consist of interior and exterior walls. The resistance component of the acoustic impedance of the external walls is such that the external walls passively dampen the vibrations of the interior walls by dispersing the vibrations. The reactive component of the acoustic impedance of the external walls is such that the external walls actively inhibit the vibrations of the internal walls, said external walls thus ensuring that each inkjet sprays drops of ink at the same predetermined distance from each respective nozzle. This type of configuration is used to prevent the nozzle bearing plate from bending in a direction parallel to the inkjet when the printer is used.

The present applicant has filed European patent application EP 0 532 406 A1 concerning multijet modules and the juxtaposition of several modules positioned side-by-side to obtain a large printing width. Much of the detailed description of the embodiment given below repeats the description of the above-mentioned application, particularly everything that relates to the mechanical fastening of print modules to a module assembly beam.

BRIEF DESCRIPTION OF THE INVENTION

As in the examples of embodiments in European patent applications EP 449 929 B1 or EP 0 532 406 A1 referred to above, the invention relates to a multijet print head, i.e. a head in which a cavity containing pressurized ink delivers several jets that are divided into drops by a single resonator for said cavity. As in the embodiment described in European patent application EP 0 532 406 A1, the invention also relates to a print head capable of being mounted such that it is aligned with other heads to constitute a print assembly comprising a large number of jets equidistant from one another capable of simultaneously printing a wide band, for example two or more meters.

The multijet cavities of the prior art described, for example, in patent applications WO 98/51503 or EP 0 449 929 B1 referred to above, enable a single resonator to actuate several jets. However, the end jets, i.e. those leaving the first and last nozzles of the cavity, spray irregularly, produce distorted drops or are formed at variable distances when said end jets are too close to the walls of the cavity.

The inventor of the present invention has used digital simulations to improve the quality of the end jets, for example by using a particular contour of the lateral wall at the nozzle plate, i.e. where said lateral wall is secant to the nozzle plate. Another factor that affects the quality of the end jets is the angle formed by the lateral wall of the cavity with the nozzle plate. The angle is preferably 90° along the entire contour of the lateral wall.

The relation between the vibrating surface of the resonator and the surface of the nozzle plate should also be taken into consideration. The relation between the surfaces should preferably be approximately 1, for example between 3/4and 4/3. The shape of the transitional surface between a resonator housing and the cavity also plays a role. Finally, the relation of the cavity measurements is also important. Each of the factors mentioned above provides an improvement and the combination of all or some of the factors enables the spray quality of the end jets to be indistinguishable from the quality obtained with the central jets.

It becomes possible to position the end-nozzles very close to the intersection of the lateral wall of the cavity with the axial line joining the nozzles. Under these conditions, even though the distance between consecutive nozzles may be small, it remains possible to create an alignment of several cavities in which all the nozzles are equidistant despite the thickness of the wall separating two consecutive cavities of the same head or two consecutive print heads.

Compared to known embodiments, the present invention also relates to an ink-drop generator suitable for a wide range of inks that does not require the drop generators to be modified and that can be produced in materials capable of withstanding temperatures to which print heads may be exposed in an industrial environment.

To achieve all these aims, the invention relates to an ink-drop generator for an inkjet printer in which an inkjet is sprayed in drops, said generator particularly comprising:

a generator body, at least one acoustic wave generator with a body elongated in an axial direction to the inkjets, each generator having a vibrating surface perpendicular to the axial direction of the jets, at least one section comprising the vibrating surface of each acoustic generator being housed in a housing of the drop-generator body, at least one resonance cavity intended to contain ink, the first section only of each cavity possibly being constituted in a main section of said body constituting the main body of the generator and, in this configuration, a second section in a continuation of said main body of the generator connected to be leaktight to the main body of the generator, each cavity having an ink feed and an ink-feed aperture, each cavity being particularly defined by a nozzle plate and a lateral wall secant to the nozzle plate, the intersection of the lateral wall and the nozzle plate defining a first contour line of the lateral wall, the nozzle plate comprising a plurality of nozzles aligned along an axial direction of the nozzles perpendicular to the axial direction of the jets, the axial direction of the jets and the axial line of the nozzles defining a plane of the jets, a generator characterized in that the lateral wall of each resonance cavity is secant to the nozzle plate perpendicular to said nozzle plate along the entire first contour line of said wall, the first contour line being formed by two equal segments that are parallel to one another and the axial direction of the nozzles, each segment having two ends: a first and a second end, the two first ends of each segment being connected by a first curved line and the two second ends of each segment being connected by a second curved line.

The lateral surface of the cavity therefore consists of two plane walls parallel to one another and, at the axial line of the nozzles, one of the walls containing one of the segments and the other, the other segment, and two curved connecting walls each containing one of the contour curves.

In one embodiment the connecting curved lines of the segment ends are concave towards the inside of the cavity. In general, in order to facilitate manufacture the curved lines are constituted by semicircles the diameter of which is the space between the two segments. Preferably, in order to facilitate a preferred vibration mode in the fluid the largest measurement 1 of the first contour of the cavity lies along the axial line of the nozzles, the distance between the two segments is approximately l/4 and the height of the lateral wall of the cavity is between l/2 and 3l/4, preferably approximately 5l/8. To enable the vibrations produced by the acoustic-wave generator to be transmitted to the ink contained in the cavity it is necessary to connect the acoustic-wave generator housing to the cavity. The connection is achieved by a hollow connector section defined by a lateral connector surface. Said connector surface is intended to connect, for example, a cylindrical shape with a circular base, the diameter of which is the diameter of the acoustic-wave generator, to a cylindrical shape with a more or less flattened rectangular base that is the shape of the lateral surface of the ink cavity. As described above, the space between the two walls of the largest surfaces of the cavity is preferably equal to l/4. The connector surface is preferably obtained as follows: to create the first section of the surface the cylindrical surface with a circular base, the diameter of which is between l/2 and 3l/4 of the acoustic-wave generator, is extended over the section of its periphery that lies between the two planes defined by the largest plane walls of the cavity separated by a distance of l/4 .

Each of the largest walls and/or a continuation of each wall is also hollowed to obtain a hollow the periphery of which is defined by a curved line in the plane of said wall and part of a circle the diameter of which is equal to the diameter of the acoustic-wave generator, said circle being located in a plane perpendicular to the plane wall of the cavity.

The base of the hollow section, which is defined as described above, may be a conical surface, for example, to obtain a progressive junction between the generator housing and the resonance cavity. This junction forms an opening with a more or less rectangular cross-section between the resonator housing and the resonance cavity. The junction of the walls between the resonator housing and the cavity is achieved progressively.

BRIEF DESCRIPTION OF THE DRAWINGS

An example of an embodiment of the invention will now be described with reference to the attached drawings where:

FIG. 2 is a longitudinal cross-section along the plane of the ink-drop generator body and its continuation;

FIG. 3 is a section through the assembled body with its continuation in a plane perpendicular to that of the jets and parallel to the nozzle plate;

FIG. 8 particularly shows a detailed view of the ink feeding pipes;

FIG. 9 particularly shows a detailed view of the ink drainage and recovery pipes;

FIG. 1 is an exploded perspective view of an assembly of mechanical parts composing part of an ink-drop generator 33 of the invention. It will be seen below that the generator 33 comprises a body 133, an ink distributor/collector 29 and an ink-drop deflection assembly 32. In the part discussed here relative to FIG. 1 the body 133 and distributor/collector 29 will be described.

Figure 1:
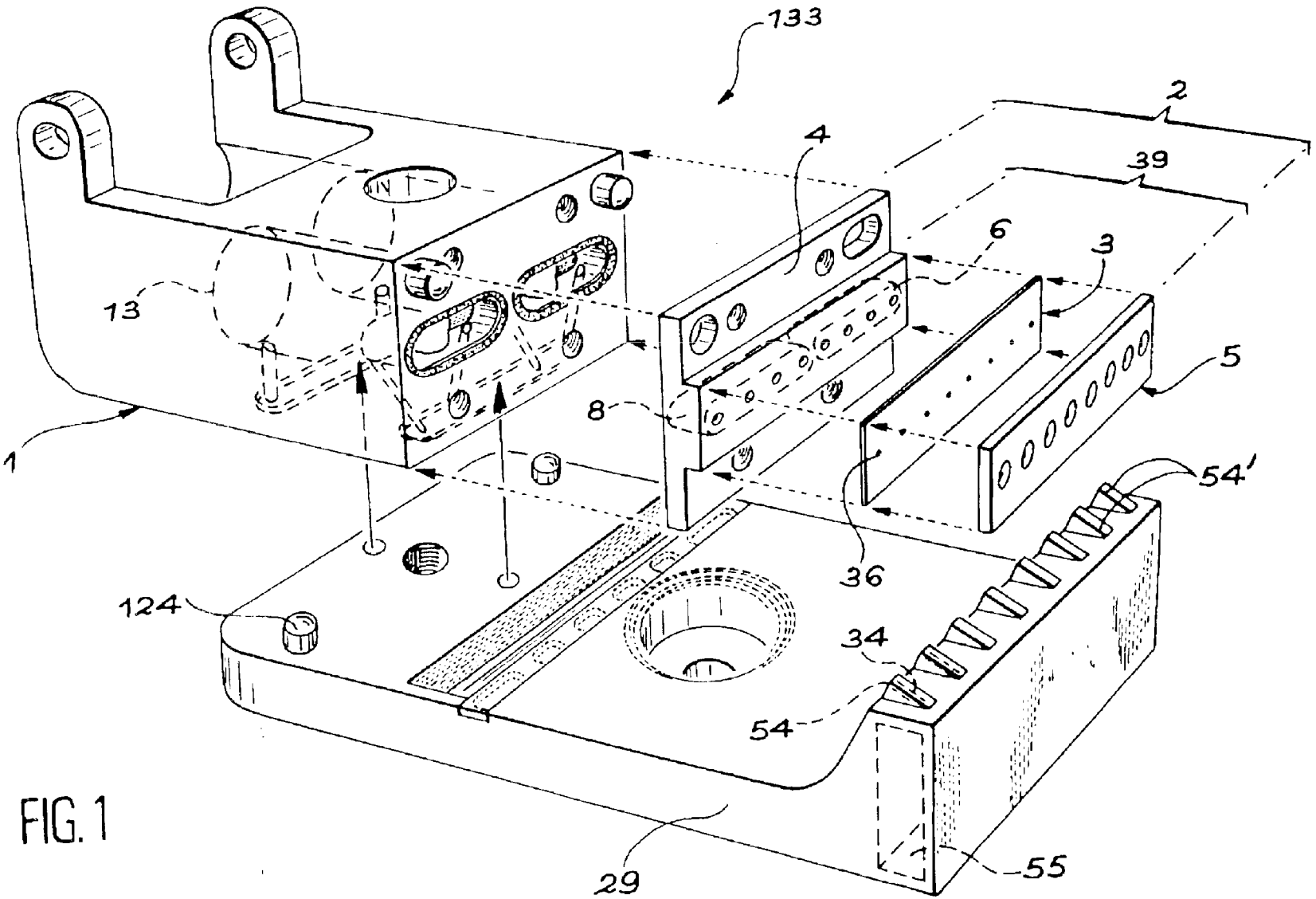
FIG. 1 is an exploded perspective view of an example of an embodiment of the mechanical parts of a print head, the said parts comprising in particular the ink-drop generator body and an ink distributor/collector.

Body 133 comprises a dual body 1 forming main body 1 and a continuation 2. Dual body 1 comprises a section with two cavities 6. Each cavity 6 is partly composed of a hollow in dual body 1 and partly of a hollow in continuation 2 of dual body 1. Continuation 2 is connected to dual body 1 by means of a sealed connection. The continuation 2 of dual body 1 is mechanically composed of a mechanical assembly of three parts, a housing 4 of a cavity part, a thin strip 3 bearing calibrated holes 36 forming nozzles and a reinforcement plate 5. The reinforcement plate 5 and strip 3 are fastened by means of a sealed connection, known per se, for example welding, to a base located outside housing 4 of some of the cavities 6. Holes in part 5 and the base of part 4 allow jets of ink to pass from inside cavity 6 through nozzles 36. This embodiment of the nozzle-plate, known per se, makes it possible very accurately to calibrate the nozzles, for example by laser-cutting thin strip 3 to form a clean, neat hole with a diameter of a few tens of $\mu$m. In the rest of the present text any reference to nozzle plate 39 is understood to refer to an assembly 39 comprising housing base 4, strip 3 and reinforcement 5.

Body 133 is divided into two sections, dual body 1 forming the main body and continuation 2 of the body for machining purposes. The opening in body 133 allows machining of the upper section of cavities 6 using a bit that machines the bottom of dual body 1 and that in the lower section of the same cavities via the top of continuation 2 of main body 1.

Other than the screws, the leaktightness, positioning and fastening means of main body 1 and its continuation 2 are shown in the drawings but not commented upon as they are known per se.

A description of a cavity 6 will now be given with reference to FIGS. 2 and 3. FIG. 2 is a cross-section along the plane of the jets of main body 1 and its continuation 2 mounted together. FIG. 3 shows a cross-section through body 133 along plane C—C of FIG. 2 close to the nozzle plate and parallel to the said nozzle plate.

A cavity 6 has the general shape of a rectangular parallelepiped of length 1, width more or less l/4 and height somewhere between l/2 and 3l/4 but preferably 5l/8. As explained above, these measurements are designed to encourage vibrations propagating along a plane wave parallel to nozzle plate 39. The shape of this cavity will now be explained in more detail with reference to FIG. 3. As stated above, this figure shows a section through a plane parallel to the nozzle plate located a very short distance from the nozzle plate. The contour of this cavity consists of two planar segments 7, 8 that are generally parallel to one another and located at an approximate distance of l/4 from one another. A side of each segment 7, 8 is illustrated in FIG. 3 as the trace in the cross-section plane of the parallel segments 7, 8 that define an inner periphery of a portion of the cavity 6. Said segments 7, 8 are connected by arcuate planar portions 9, 10 a side of each arcuate planar portion 9, 10 being illustrated in FIG. 3 as the trace in the cross-section plane of the arcuate planar portions 9, 10. It will be seen from this drawing that cavity 6 is not altogether parallelepiped-shaped since a portion of its inner periphery includes arcuate formations causing the cavity 6 in this case the shape of half-cylinders with circular bases. As can be seen from FIG. 2 or FIG. 4, which is a cross-section through body 133 along line B—B, shown in FIG. 2, of a cavity, that also passes through the axis of a jet, arcuate planar portions 9, 10 and segments 7, 8 of the cavity 6 are joined perpendicularly to nozzle plate 39. This shape makes it possible to avoid upward reflections of waves on the walls induced by the V-shaped form of these walls as described in the WO patent application cited above in the description of the prior art. This shape therefore makes it possible to obtain more regular vibration of the ink in the cavity 6.

In each cavity the apertures 11, shown particularly in FIG. 2, provide the cavity with a supply of pressurized ink. The ink flows through the nozzles 36 once the printer is operating. During jet startup, shutdown or maintenance, the ink may also be supplied in large quantities via aperture 12. This aperture has a cross-section greater than the sum of the cross-sections of the two ink-supply apertures 11.

The direction of the ink feeding pipes 11 is in the plane of the preferred vibration mode, perpendicular to the direction of the jets in order to minimise vibration disturbance. With the same end in mind they are also directed more or less along the smallest measurement l/4 of the cavity in order to minimise coupling with the main mode of interference vibration, which is that oriented along the largest measurement 1 of the cavity.

The two feed apertures 11 are located symmetrically relative to a central plane of cavity 6 perpendicular to the plane of the jets, and immediately below upper surfaces 107, 108 of the cavity. Ink outlet aperture 12 is located in a housing 13 of acoustic wave generator 14. The ink supplied via apertures 11 is intended to keep the cavity filled and under pressure while the ink leaves via the nozzles 36. The ink outlet aperture 12 is used during startup, shutdown and hydraulic maintenance phases of the print head. The relative disposition and cross-sections of ink inlet aperture 11 and ink outlet aperture 12 are optimized to ensure uniform distribution of the ink to the nozzles, so as to ensure that the ink in the cavity is not disturbed by the ink-flow pulsations coming from the ink circuit, to ensure that the ink in the cavity is replaced rapidly (draining), and to eliminate any air bubbles in the cavity by ensuring that there is a high flow-rate of liquid during hydraulic maintenance sequences. The body also contains housings 13 each provided for an acoustic wave generator 14 already known per se that has the basic shape of a cylinder 15 ending in a surface 16 that is parallel to the plane of the nozzles, said surface 16 constituting the vibrating surface of the acoustic wave generator. The section of the housing 13 of the acoustic wave generator 14 closest to the cavity has the shape of a cylinder 17.

Figure 4:
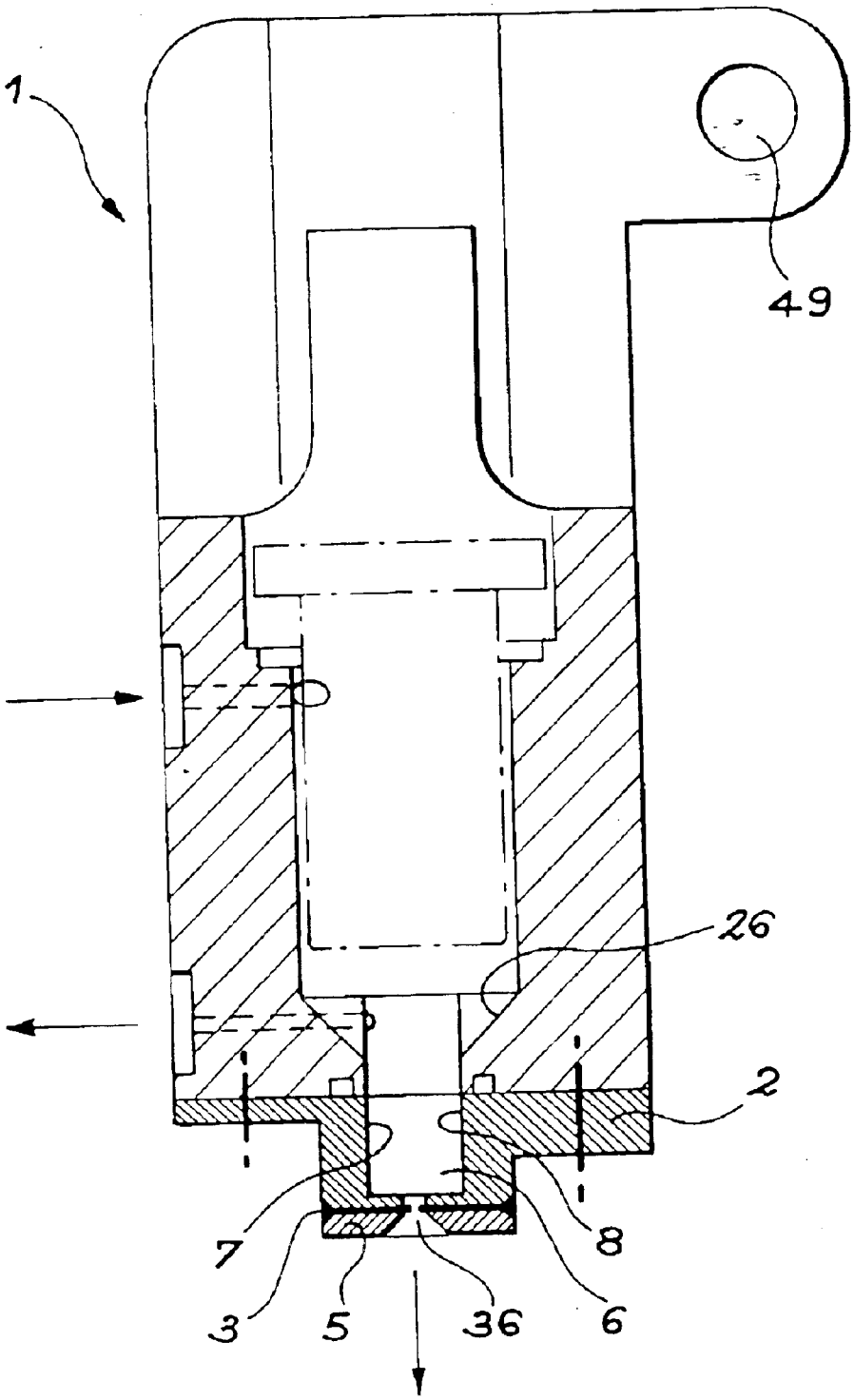
FIG. 4 is a transverse cross-section along a plane perpendicular to that of the jets and that of the nozzle plate of the ink-drop generator body and its continuation.

In FIGS. 2 and 4 the acoustic wave generator 14 is shown in dotted lines, firstly in a position close to its assembled position, and secondly once in its assembled position. In the assembled position the contour of the acoustic wave generator 14 is practically identical in FIGS. 2 and 4 with that of the housing of the generator 14. In the drawings, particularly FIGS. 2 and 4, the housing of the acoustic wave generator 14 is located above cavity 6. This "above" position is in no way compulsory in practice. However, the terms "above" and "below" are used as a convenient spatial reference to describe the position of components relative to one another. In the example shown, the cylinder of the acoustic wave generator 14 is of diameter l/2, i.e. half the length of cavity 6 and its axis lies both in the plane of the jets and equidistant between the ends of cavity 6. In operation, the vibrating surface 16 of generator 14 is located level with the upper section of the cavity 6. This arrangement is in no way compulsory and this surface may be disposed slightly higher in the housing 13 of the acoustic wave generator. Given the shape of the acoustic chamber and the shape of the housing of generator 14, in order for the acoustic waves to be transmitted efficiently and in a preferred vibration mode through the ink in cavity 6, it is necessary to provide a connection 18 between housing 13 of acoustic wave generator 14 and cavity 6. This connection 18, which consists of a hollow in the segments 7, 8, will now be described.

It should first be noted that in terms of the width of cavity 6 the connection is provided by the continuation of the cylindrical surface of housing 13 of acoustic wave generator 14. This point will be explained in greater detail below with reference to FIG. 5A.

FIG. 5A shows the shape of the cross-section of cavity 6 as a plane parallel to the plate 39 carrying the nozzles 36. The projection on the cross-section plane of cylinder 17 forming the housing of acoustic wave generator 14 is also shown in dotted lines on a section outside cavity 6 and in unbroken lines inside cavity 6. The centre of the circle representing this projection is located on the longitudinal axial line of cavity 6 equidistant between the two ends of this cavity. For the sections of the connection located between the two planar segments 7 and 8 of cavity 6 shown in FIG. 5A, the connection surface includes as shown in part A of continuations 19 and 20, shown by unbroken lines, of the cylindrical section 17 of the housing 13 of acoustic wave generator 14. In this way, looking at connection 18 along an axial line of a jet, it will be seen to have a shape whose projection onto the cross-section plane shown in FIG. 5A will now be explained.

This opening is composed of a closed cylindrical surface comprising, on the one hand, continuations 19 and 20 of the cylindrical surface and, on the other, the flat parts of the surfaces of the planes containing segments 7 and 8 lying between the ends of said continuations 19 and 20 of the cylinders. The shape of that section of the lateral surface of connection 18 that lies between continuations 19 and 20 of the cylindrical surface will now be explained.

Figure 5:
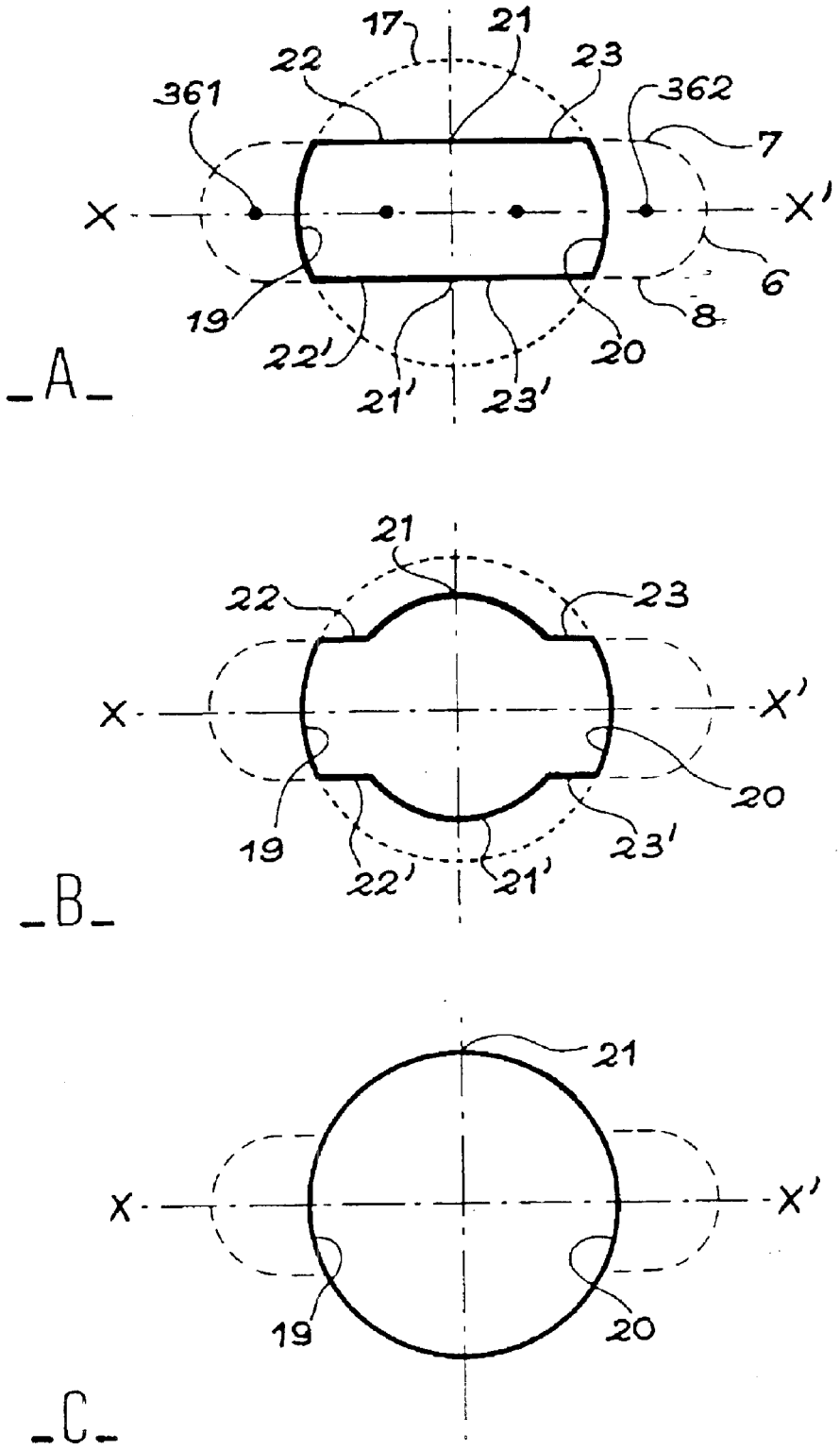
FIG. 5 are in three parts, A, B and C; these three parts of the figure show the shapes of the contours of the intersection of the connection surface between the housing of the sound wave generator and the cavity, the said sections being along planes parallel to the nozzle plate.

In order to define this shape, FIG. 5B shows a cross-section through the wall of connection 18 in a plane parallel to the nozzle plate located between a low end section and a high end section of connection 18. The cross-section of this connection consists of a line comprising, in order, an end of continuation 19, a straight section 22 that is part of segment 7, followed by a curved section 21, and finally another section 23 of segment 7, an end of continuation 20 and sections 23', 21', 22' that are respectively symmetrical with sections 23, 21, 22 relative to a longitudinal axis XX' of the cavity. We will now consider the variations in the length of said curved section 21 between the low end section of the wall and the high end section. In the low end section of connection 18 the length of curved section 21, shown in part A of FIG. 5, is nil such that the perimeter of the section is composed of sections of continuations 19 and 20, sections 22, 23 of segment 7 joining the ends of continuations 19 and 20 and sections 22', 23' of segment 8 joining the ends of said continuations 19, 20. When the cross-section plane located between the low end sections and the high end sections approaches the high end section the measurements of sections 22, 23 located between curved section 21 and each of continuations 19, 20 respectively diminish and the length of section 21 increases. As the high end section as shown in part C of FIG. 5 is reached the length of sections 22 and 23 is nil and curve section 21 consists of a circular section forming a continuous arcuate portion extending between continuations 19 and 20.

Naturally if housing 13 and generator 14 were not circular cylinders but had a different shape, section 21 at the top would have the shape resulting from an intersection of this shape with a plane parallel to the nozzle plate. In the example described the intersection of high end section of connection 18 with a plane parallel to nozzle plate 39 consists of a circular closed line whose diameter is equal to the diameter of housing 13 of acoustic wave generator 14, for example l/2. The perimeter of this line is the perimeter of the circle. For an intermediary plane between the high end section and the low end section the perimeter of the straight cross-section of connection 18 by a plane parallel to nozzle plate 39 is formed on the one hand by continuations 19, 20 of the circle, by sections 22, 23 of segment 7, by a curved section 21, by parts 22', 23' of segment 8 and by a curved section 21'. The perimeter of this intermediate cross-section is therefore smaller than the diameter of the circle located at the high end section. Similarly, coming to the low end part, the cross-section of connection 18 by a plane parallel to nozzle plate 39 has the shape shown in part A, i.e. two sections 19, 20 of a circle and two continuations of segments 7 and 8 located between said two sections of continuations 19, 20. The perimeter of the low end part, shown in part A, is therefore smaller than the perimeter of the intermediate lower part shown in part B. Therefore the shape of connection 18 can be characterized by saying that the perimeter of its cross-section by a plane parallel to nozzle plate 39 reduces the further the plane of intersection is from the upper limit and approaches the lower limit.

It will also be noted that the ends of each of sections 21, 21' are located facing one another and thus separated from one another by a distance between segments 7 and 8 of the first contour. In order for good plane propagation of the acoustic waves to occur, the walls of cavity 6 and connection 18 need to have rotational symmetry, i.e. symmetry relative to an axis or to two perpendicular planes passing through the said axis.

In one simple embodiment, part of connection 18 is made using a conical drill bit with an angle at its tip of, for example, 90°. When the bit is conical the different sections 21 are segments of circles of nil diameter at the lower end section and a diameter equal to that of housing 13 of the acoustic wave generator 14. This embodiment is shown in FIGS. 2 and 4. In FIG. 2 the intersection of the cone with the plane of segment 7 of the cavity results in a segment 24 of a hyperbola while FIG. 4, in which the cross-section is along section B—B, i.e. more or less along the axis of housing 13 of acoustic wave generator 14, the intersection has the shape of two 90° segments 26. In this example, moreover, the low end section of housing 13 coincides with the high end section of cavity 6 and thus a low end section 25 of connection 18 is positioned at a distance from the top of cavity 6 slightly less than half the diameter of the cylindrical section of housing 13 of acoustic wave generator 14.

Another important characteristic of the invention will now be explained. As was seen above, because the segments 7, 8, and arcuate planar portions 9, 10 of the cavity are perpendicular to the nozzle plate 39 at the level of said nozzle plate 39 and that the section of connection 18 between the lower surface 16 of acoustic wave generator 14 and cavity 6 is created progressively, a plane wave perpendicular to the axis of housing 13 propagates in cavity 6. As this wave is plane, no problems are created due to boundary effect. Consequently a nozzle 361, 362 may be positioned very close to one of arcuate planar portions 9, 10 without its operation being affected. For example, it will be seen from FIGS. 2 and 3 that an end-nozzle 361 is located very close to the arcuate planar portion 10 of cavity 6. Similarly it will be seen that an end-nozzle 362 is located very close to the arcuate planar portion 9 separating two identical cavities of body 133. The closeness of nozzle 361 to the arcuate planar portion 10 allows the axis of the nozzle to be at a distance less than half the interval between two consecutive nozzles of the cavity even if said interval is small. Similarly the distance between end-nozzle 362 of arcuate planar portion 9 between two cavities 6 allows the distance between this nozzle 362 and the next consecutive nozzle located in the other cavity of body 133 to be less than the distance between two consecutive nozzles in a single cavity. Hence the interval between consecutive nozzles of all the nozzles in the two cavities remains equal, even when it is small. Moreover, due to the fact that the distance between one end-nozzle and the outer surface of the portion where it intersects with the axis of the nozzles is less than half the interval between two nozzles, it becomes possible to place side by side two modules that are, for example, identical or have the same characteristic that the closeness of the nozzle of one cavity relative to the outer surface of the body containing said cavity, without the interval between two consecutive nozzles of the resulting assembly being modified.

To take the best advantage of this fact without the tolerances of an assembly of different bodies 133 resulting from the accumulated effect of the measurement tolerances on each body, each body is fitted with positioning pins 124 that cooperate in a way known per se with positioning holes on a support beam 28 bearing the alignment of the bodies. Clearly the effect would be the same if the pins were on the alignment beam and the bodies fitted with positioning holes.

In the example explained here and shown particularly in FIG. 1, the positioning pins 124 are not fastened directly onto main body 1. Body 1 is fastened onto an ink distributor/collector 29. The distributor is an intermediate part used to connect body 133 to the ink circuit. For this purpose it has as many ink collection gutters 34 as there are nozzles and ink inlets and outlets known per se to maintain cavity 6 under pressure. Part 29 is connected to body 133 by any fastening means and is positioned by positioning means, for example by continuations of the pins 124 fitting into the holes (not shown) in body 133.

It will be seen that in the embodiment described above the surface of nozzle plate 39 is $$\frac{l^2}{16}\left(3+\frac{\pi}{4}\right)$$

and that the vibrating surface 16 of the resonator is $$\frac{\pi l^2}{16}$$

such that the relation of the values of these two surfaces is $$\left(\frac{3}{\pi}+\frac{1}{4}\right)$$

or approximately 1.15.

Figure 6:
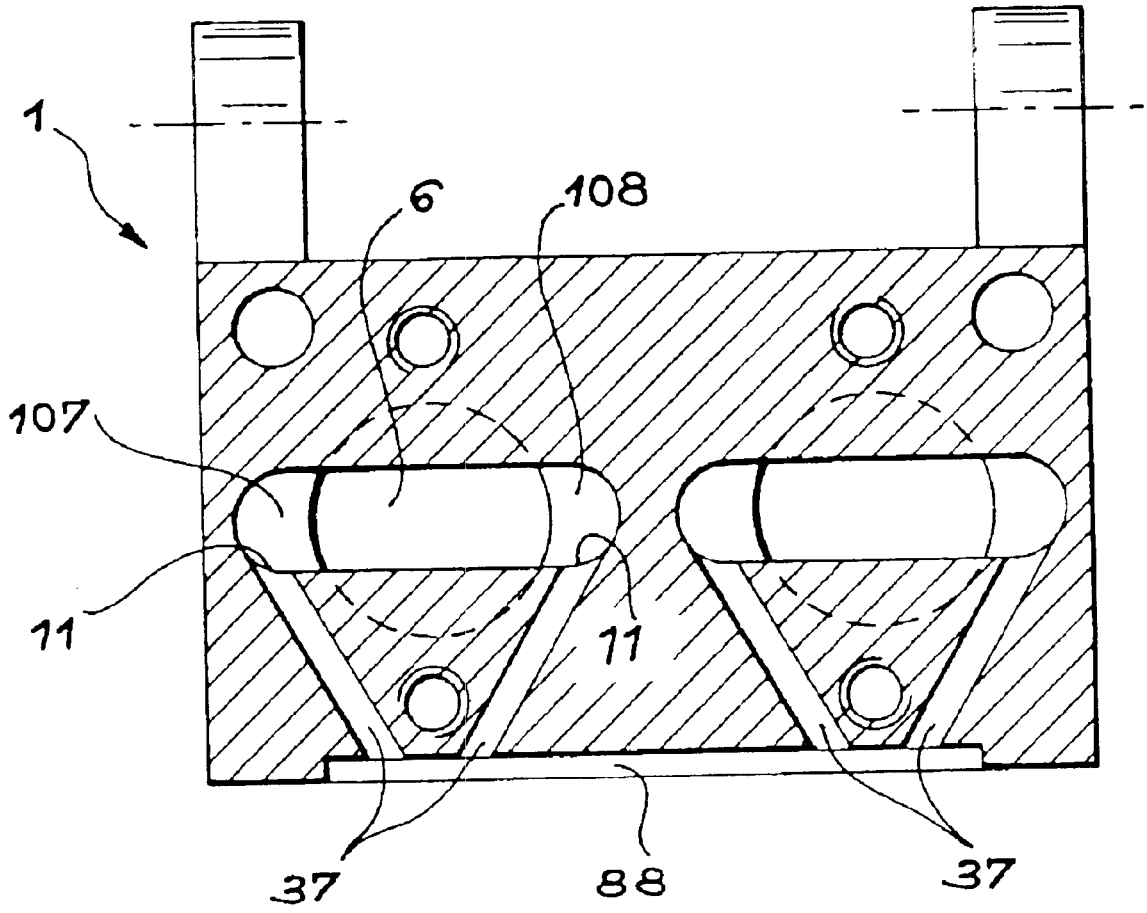
FIG. 6 is a cross-section through the generator body along line E—E of FIG. 2.

The location of the ink inlet and outlet apertures will now be described with reference to FIGS. 2 and 6. FIG. 6 is a cross-section through dual body 1 at apertures 11 and 12 in a plane parallel to nozzle plate 39.

As shown in FIG. 2, the ink inlet apertures 11 are each located at one end of cavity 6 more or less directly above end-nozzles 361, 362 respectively.

Since the diameter of the nozzles is very small (approximately 50 $\mu$m), the rate of ink flowing through them is very slight. It follows that the ink-flow supplied to the nozzles is also very small. The cross-section of ink inlet apertures 11 and ink outlet apertures 12 is set at a measurement considerably greater than the diameter of the nozzles such that the speed at which the ink still in the cavity travels is very slight. The ink is therefore subject to the vibrations of the transducer while it is virtually static.

The disposition of the ink inlet apertures 11 on the top ends of cavity 6 and immediately beneath upper surfaces 107, 108 respectively of cavity 6, which at this point mask the propagation of acoustic waves, limit the disturbance of vibrations by the ink-low.

During maintenance operations the ink outlet occurs higher through an aperture 12 (shown in FIG. 2) located in the cylindrical section 15 of housing 13 of acoustic wave generator 14. The ink flows towards outlet aperture 12 from cavity 6 through a clearance between the cylindrical section 15 and acoustic wave generator 14. The use of a single outlet aperture 12 eliminates areas of static fluid and optimizes drainage of the ink cavity. Finally, in normal operation the solenoid valves controlling the print head prevent ink from flowing through outlet aperture 12; the ink around this aperture is therefore static. It also acts as a lubricant and vibration insulator for the acoustic wave generator 14.

FIG. 6 shows ink pipes 37. The outermost sections of these pipes join curved surfaces 9, 10 such that they are tangential in order to optimise the drainage of the cavity. The two pipes 37 are symmetrical to one another relative to a perpendicular plane of the jet plane. They open into a distribution throat 88 located between dual body 1 and collector/distributor 29.

The assembly of generators or ink print modules 33 that each comprise a body 133 and an ink collector is described below with reference to FIGS. 7–9.

Figure 7:
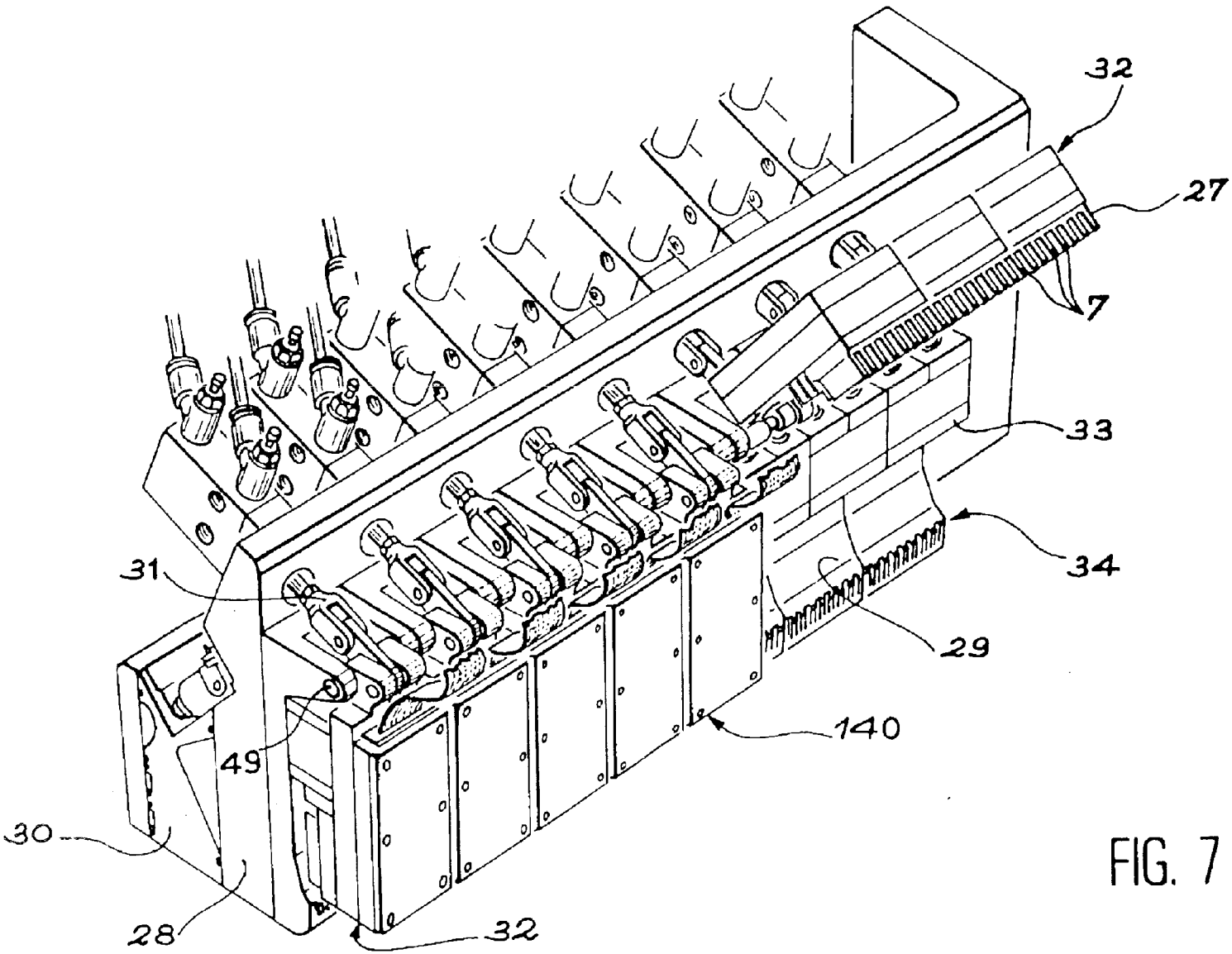
FIG. 7 shows a perspective view of part of a printer comprising an alignment of print heads comprising ink-drop generators of the invention.

An example of this kind of module mounted on a beam 28 is shown in FIG. 7. FIG. 7 is a view showing a printing device comprising an assembly of eight print modules 140 of m=8 print jets 27 that form a continuous row of 64 regularly spaced print jets. The eight print modules are mounted adjacent to one another on a supporting beam 28 common to all the modules. Each print module comprises:

a collector/distributor 29 a multijet deflector assembly 32 a body 133 the collector/distributor, which is a one-piece body 29 comprising gutters 34 for collecting the non-deflected drops of each jet, supports body 133 which is capable of delivering 8 inkjets through 8 nozzles 36; the eight inkjets are regularly spaced in a plane parallel to beam 28;

multijet deflector assembly 32 is shown in two positions: in the low, or working position on the modules located the furthest to the left of FIG. 7 and in the high, or maintenance position on the modules located the furthest to the right. The function of this type of deflector assembly and its construction are known in themselves. They will only therefore be described briefly below. When each jet of liquid leaves nozzles 36 it breaks up into micro droplets and passes through multijet deflector assembly 32 where certain drops are electrically charged by charge electrodes then deflected from their initial trajectory towards gutter 34 by deflecting electrodes, said deflecting and charge electrodes belonging to deflector assembly 32, to create an impact on a printing substrate that scrolls in front of the printing module. This type of multijet deflector assembly 32 to deflect m=8 inkjets is described, for example, described in French patent application No. 91 05475 filed by the present applicant on 3 May 1991.

An actuating part 31 that rotates multijet deflector assembly 32 around an axis 49 is constructed as part of supporting beam 28.

Figure 8:
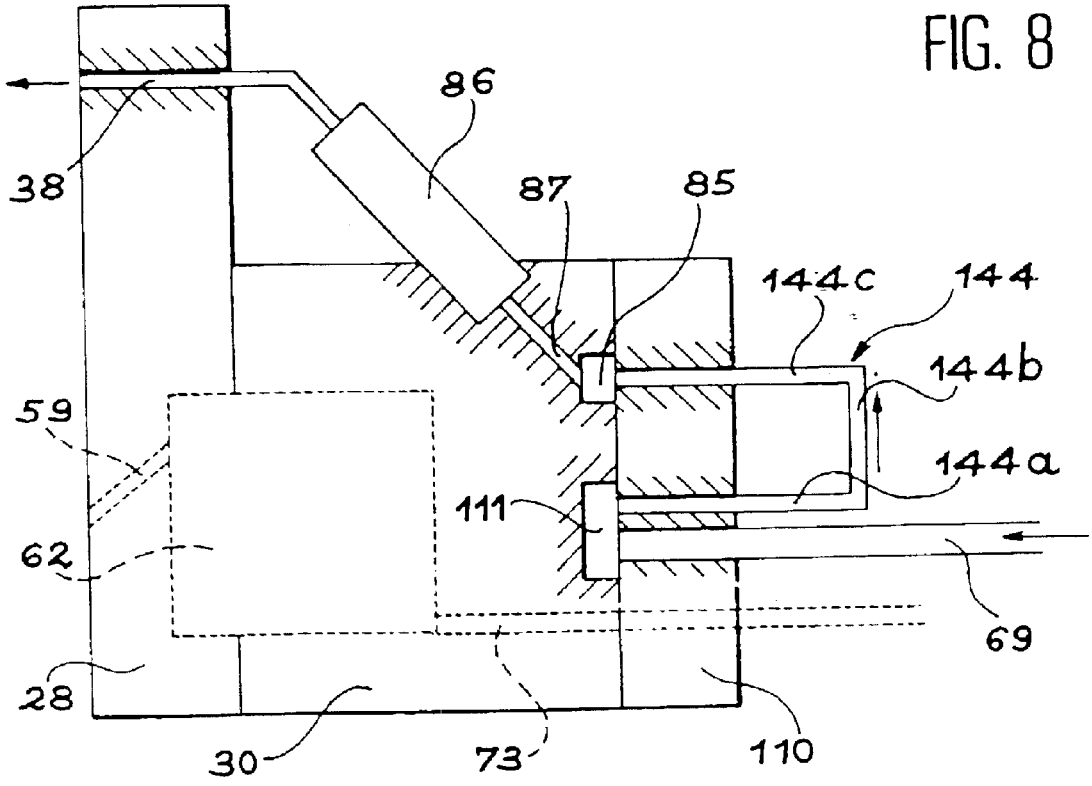
FIGS. 8 and 9 show schematic views of cross-section of the part located behind a multijet print module fitted on a supporting beam of a plurality of modules.
Figure 9:
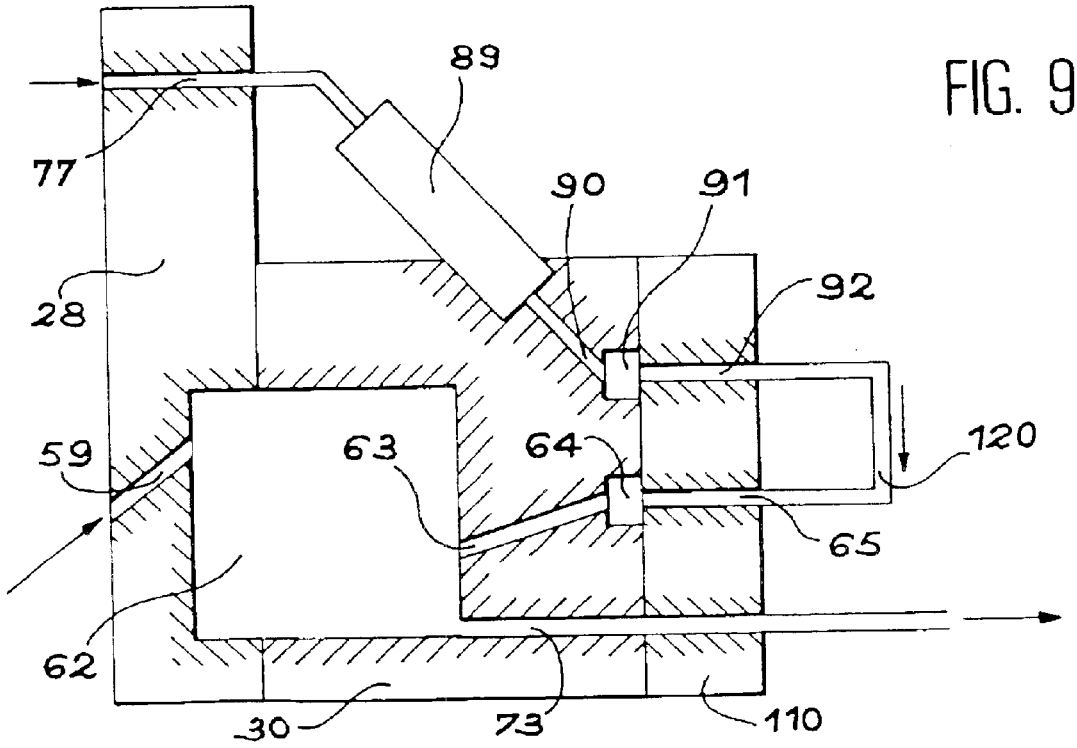

It will be seen in reference to FIGS. 8 and 9 that the side of supporting beam 28 opposite that bearing collector 29 of each print module is associated with a single part 30 that creates, in combination with said beam 28, a tank 62 for collecting or draining the ink from the collector gutters of the eight print modules and, in combination with a single plate 110, a single cavity 111 for distributing the ink to the eight devices 33 for generating the eight inkjets. Support beam 28 has internal pipes that connect, on the one hand, collector tank 62 and, on the other, gutters 34 of generator devices 33 mounted on supporting beam 28 and the internal supply pipes.

It should be noted that FIGS. 8 and 9 are essentially schematic cross-sections to support the description and are not actual cross-sections of the device. It is for this reason that pipes in the figures are not always in the cross-section plane but in the parallel planes. The schematic cross-section of FIG. 8 is mainly of a plane of the feed pipes of a print module 33 and a plane of ink-collector pipes undirected towards a printing substrate from gutters 34. The pipes used for ink collection are not necessarily in the same plane as those used for the supply.

Similarly, FIG. 9 mainly shows the plane of the ink drainage and collection pipes but the pipes relative to these two functions are not necessarily in the same plane.

As described above, body 133 is supplied with ink through pipes 37 pierced in body 133 and a collector throat 88 between body 133 and collector 29. Throat 88 communicates with the rear of collector 29 via a hole pierced through said collector, as shown in FIG. 1 by an arrow. Similarly, drainage opening 12 communicates with the rear of collector 29 via pipes pierced in body 133 and collector 29. Gutters 34 for collecting unused ink drops from a jet, i.e. non-deflected drops, provided in the lower section of collector 29 communicate with the rear section of collector 29 via an internal pipe of said collector 29. The eight internal pipes open into a suction cavity of collector 29.

FIGS. 8 and 9 show the workings at the rear of collector 29 in terms of the ink circuits.

The ink supply circuit of each print module will now be described with reference to FIG. 8. This figure is a schematic transversal cross-section through a supporting beam 28 of an assembly of modules and components on the rear section of said beam 28. A part 30 is assembled onto beam 28 by bolts and impervious seals (not shown). These bolts are also used to assemble a rear plate 110 to the rear of part 30.

Ink is distributed to all cavities 6 of the eight modules by a pressurized distributor 111 created on the rear surface of part 110. The distributor communicates with pipes 38 pierced through beam 28 via pipes that are preferably rigid, such as pipe 144 shown in FIG. 8 and solenoid valves 86 called feeding valves. In FIG. 8 a single connector pipe 144 between distributor 111 and a single solenoid valve 86 are shown. In fact there are as many pipes, solenoid valves 86 and pipes 38 as print modules.

Pressurized cavity 111 communicates with ink pressurizing means (not shown) via a connector 69.

A tank 62, shown in FIGS. 8 and 9, is created by a first cavity provided in beam 28 and a second cavity provided in part 30. The collection and drainage circuit will now be described with reference to FIG. 9.

Tank 62, called the collector or drainage tank, is connected to a solenoid valve 89, called a drainage valve, via a pipe 63 of part 30, a throat 64 between parts 30 and 110, a pipe 65 pierced in part 110, an external pipe 120, a pipe 92 of part 30, a throat 91 between parts 30 and 110 and a pipe 90 pierced in part 30. Said solenoid valve 89 is also connected to the rear of collector 29 by a pipe 77. Said pipe 77 communicates with opening 12 of cavity 6 through collector 29 and body 133. Tank 62 is common to all the print modules mounted on beam 28, i.e. the eight modules shown in FIG. 7. There is a pipe 77, 90, 65, 63, a throat 91, 92 and a drainage solenoid valve 89 for each print module. Tank 62 also communicates with the collector gutters of collectors 29 via pipes 59 pierced in beam 28. The single tank 62 communicates with a suction pump (not shown) via a single 73 pipe pierced through parts 30 and 110.

During printing the non-deflected ink from gutters 34 is permanently sucked and returned to the ink circuit. In the drainage mode solenoid valves 89 are open and the suction pump sucks ink from tank 62 collected from the gutters and openings 12 of cavities 6.

Another aspect of the invention will now be described with reference to FIG. 10 that shows a rear perspective view of a supporting beam 28. As explained above the rear surface of support 28 is associated with a single part 30 that creates, in combination with said beam 28, a collector or drainage tank 62 (FIGS. 8, 9) and, in combination with a plate 110, a cavity 111 for distributing ink to the eight devices 33 for distributing eight inkjets.

Figure 10:
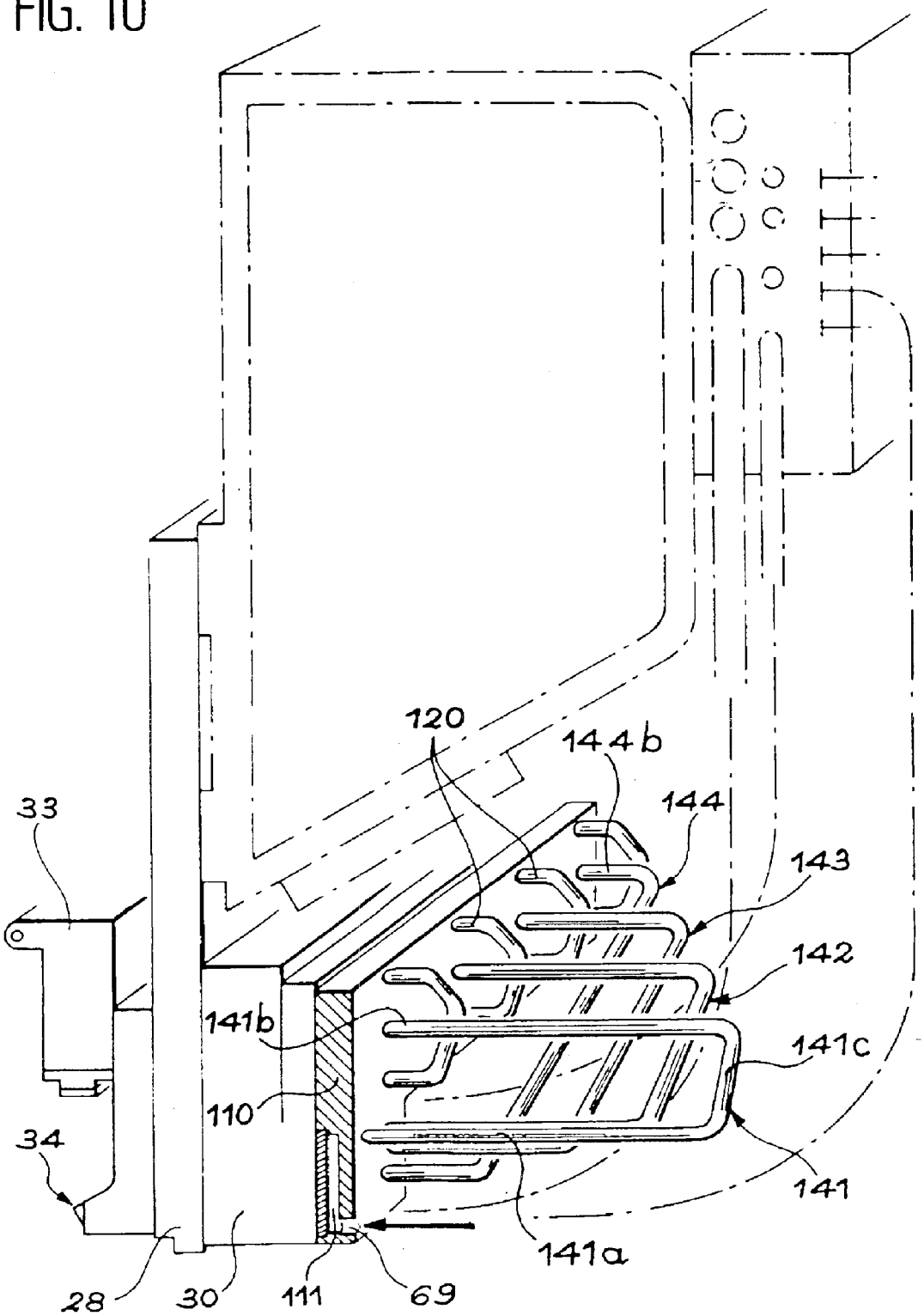
FIG. 10 shows part of a printer designed to show the shape of the feeding pipes of the various ink generators.

The aim of FIG. 10 is to show a characteristic of pipes 141–144 that each supply an ink generator 33.

The aim of this characteristic is to ensure that the pressure drops are identical in each pipe 141–144 joining distribution cavity 111 to each generator 33, irrespective of the position of the generator relative to cavity 111.

To this end all pipes 141–144 are of the same length.

Moreover, all the pipes include the same number of elbows. The value of an elbow angle of a pipe is identical on all the other pipes.

These characteristics of pipes will now be described in detail in reference to FIG. 10. As this figure is a semi-cross-section, only four pipes are visible. A pipe that supplies four other pipes symmetrical to pipes 141–144 relative to a plan perpendicular to beam 28 is not shown.

Each connector pipe has a start end section 141*a*–144*a* perpendicular to plate 110 and a finish end section 141*b*–144*b* also perpendicular to plate 110. The end sections of a pipe, for example 144*a*, 144*b*, are connected together by a central pipe section 144*c* parallel to plate 110. The length of this section varies depending on the distance between the supply point of a generator 33 and the starting point of cavity 111. The sums of the lengths of sections a, b, c of each pipe 141–144 are equal. This means, for example, that central section 141*c* of pipe 141 that supplies a generator 33 close to central supply cavity 111 is shorter than central section 144*c* of pipe 144 that supplies a generator 33 further away from cavity 111. On the other hand end sections 141*a*, 141*b* of pipe 141 are longer than sections 144*a*, 144*b* of pipe 144. Given the different configurations pipes 141–144 are nevertheless equal in length. They each comprise two connector elbows that are at right angles and with the same radius of curvature. All the pipes are rigid, for example metal, to enable them to retain their shape. In the example of FIG. 10 it was not necessary to include a section of S-shaped piping to absorb the dilations although one could be provided depending on the conditions of use of the printer assemblies. The position of the S-shaped sections in the piping matters little, it being essential however that they are identically shaped and connected to the rest of the piping.

A printer of the invention comprises one or more supporting beams 28 equipped with print heads 32 that enable ink to be sprayed towards a printing substrate. In principle when there are several beams each beam prints a different colour ink such that a colour image is produced. The advantage of a printer configured according to the invention is that an entire width of the substrate may be printed simultaneously. Under these conditions a relative movement of the print heads and the substrate in a parallel direction to beam 28 is no longer necessary because the width that is printed simultaneously can be adapted to the width of the substrate. The only remaining movement is that of the head relative to the substrate in a direction perpendicular to support beam 28. This may be a continuous, rapid movement.

Figure 11:
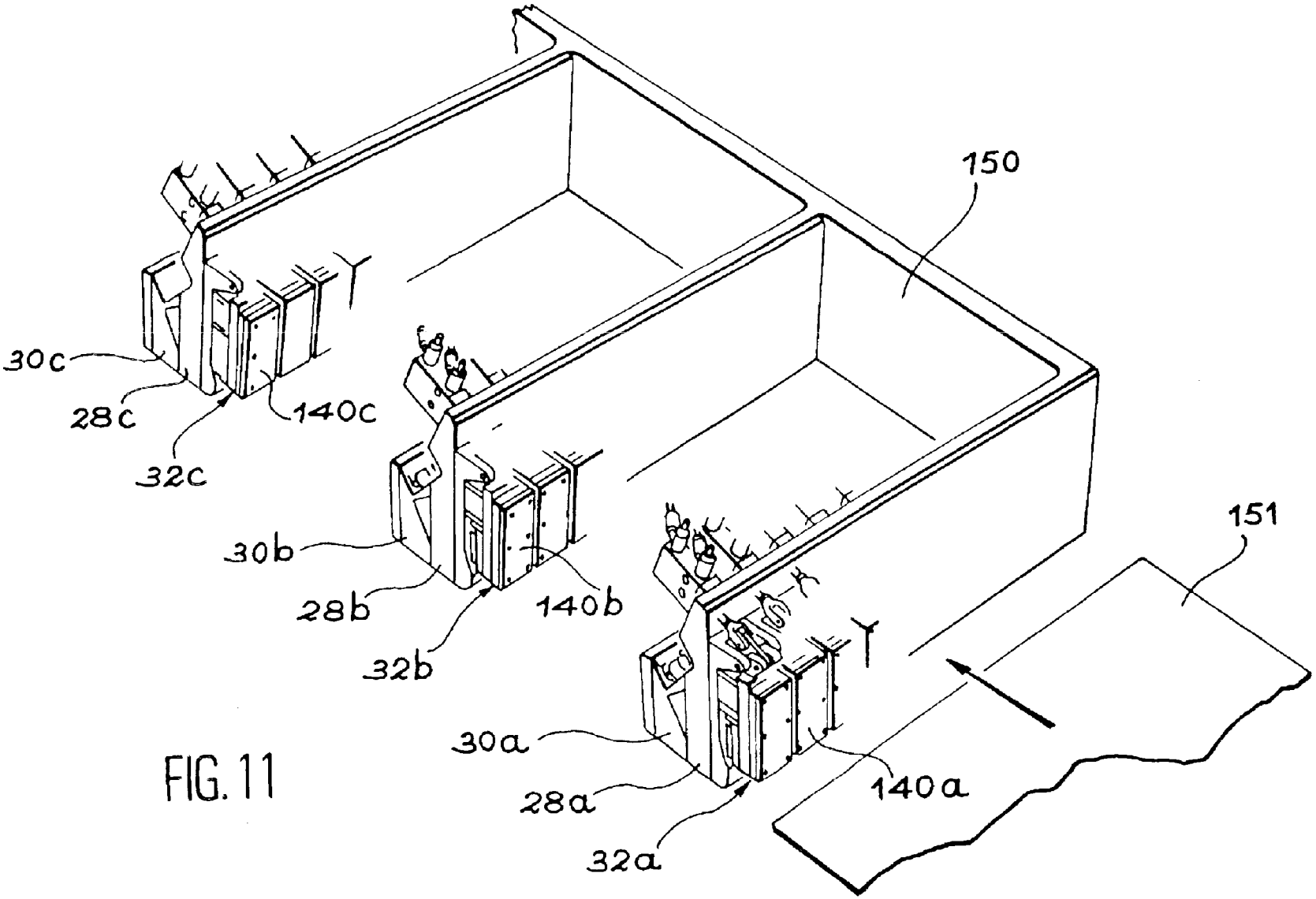
FIG. 11 shows part of a printer comprising several alignments of print heads arranged in series.

FIG. 11 shows a printer provided with several support beam assemblies 28 positioned parallel to one another and printing the same substrate scrolling perpendicular to the beams. FIG. 11 is a schematic perspective view of this type of configuration. A support frame 150 holds a set of beam assemblies 28*a*, 28*b*, 28*c*.

Means (not shown) enable substrate 151 to scroll under the inkjets of print modules or heads 14*a* of beam 28*a*, then 140*b* of beam 28*b* and 140*c* of beam 28*c*.

The beam 28*a* the furthest upstream relative to the scrolling substrate periodically prints a reset mark, for example on an edge of the substrate. Each downstream beam 28*b*, 28*c* is provided with a position sensor (not shown) to detect these marks and enable the pixel data of the line to be reset virtually continuously. Good superimposition of colours is therefore obtained.

What is claimed is:

1. An ink-drop generator for an inkjet printer in which an inkjet is sprayed in drops, said generator particularly comprising:

a generator body, at least one acoustic wave generator with a body elongated in an axial direction to the inkjet, each generator having a vibrating surface perpendicular to the axial direction of the jets, at least one section comprising the vibrating surface of each acoustic generator being housed in a housing of the drop-generator body, at least one resonance cavity intended to contain ink, the acoustic-wave generator housing and the cavity being connected by a hollow connector section defined by a lateral connector surface, said lateral surface having, along the axial line of the jets, a lower limit in the cavity and an upper limit close to the acoustic generator housing, the upper limit of the transverse cross-section of said surface being circular with a diameter equal to that of the acoustic-wave generator housing, the intersections of this surface with the planes parallel to a nozzle plate, these planes planes being located under the upper limit and above the lower limit, being closed curves the perimeter of which diminishes when an intersection plane moves away from the upper limit, a first section only of each cavity being constituted in a main section of said generator body and, in this configuration, a second section in a continuation of said generator body connected to be leaktight to the generator body, each cavity having an ink feed, each cavity being defined particularly by the nozzle plate and a wall, the intersection of the wall and the nozzle plate defining a first plane contour line of the wall, the nozzle plate comprising a plurality of nozzles aligned along an axial direction of the nozzles perpendicular to the axial direction of the jets, the axial direction of the jets and the axial direction of the nozzles defining a plane of the jets, a generator characterized in that the wall of each resonance cavity is perpendicular to said nozzle plate, the first contour line being formed by two equal segments that are parallel to one another and the axial direction of the nozzles, each segment having two ends: a first and a second end, the two first ends of each segment being connected by a first curved line and the two second ends of each segment being connected by a second curved line.

2. The generator of claim 1 characterized in that each curved line is concave towards the inside of the cavity.

3. The generator of claim 2 characterized in that the first and second curved lines are constituted by semicircles the diameter of which is the space between the two equal segments.

4. The generator of claim 1 characterized in that the largest measurement l of the first contour of the cavity lies along the axial direction of the nozzles, the distance between the two segments being approximately l/4 and the height of the wall being between l/2 and 3l/4.

5. The generator of claim 4 characterized in that the acoustic-wave generator has a circular, transverse cross-section the diameter of which is between l/2 and 3l/4.

6. The generator of claim 5 characterized in that one part of the acoustic-wave generator housing has an opening having a cross-section the length of which is more or less equal to l/2.

7. The generator of claim 1 characterized in that for the sections of the connector surface located in the cavity the intersections of the connector surface with the planes parallel to the nozzle plate comprise two curves symmetrical to one another relative to the jet plane, the ends of each of these curves being separated from each other by the distance between the segments of the first contour.

8. The generator of claim 1 characterized in that the connector surface forms an opening between the acoustic-wave generator housing and the cavity, said opening having a cross-section the length of which is more or less equal to l/2.

9. The generator of claim 1 characterized in that at least part of the connector surface is formed by two sections of conical surface that are symmetrical to each other relative to the jet plane.

10. The generator of claim 1 characterized in that one of the ink-feed apertures is located at one end and the other at a second end of a segment of the cavity, and an ink outlet opening in the body housing is located at a top of the cavity.

11. The generator of claim 1 characterized in that the nozzles of the cavity are equidistant and that the distance between an end nozzle and of an end cavity of the body and a section of the external wall of the body located at the intersection of said wall with the jet plane is shorter than half the distance between two consecutive nozzles of the nozzle plate.

12. A print head characterized in that the print head comprises an ink generator of claim 11 and a multijet deflector assembly, said assembly comprising charge and deflector electrodes to charge and deflect or not deflect the drops from each jet.

13. An inkjet printer characterized in that the printer is equipped with a plurality of ink-drop generators of claim 11, the generators being aligned side-by-side such that the distance between an inkjet of an end nozzle of a generator and the closest nozzle of a connected ink generator is equal to the distance between consecutive jets of the same generator.

14. Printer The printer of claim 13 characterized in that the printer comprises a pressurized ink distributor that supplies the various generators with ink via pipes and in that the lengths of said pipes are equal between a distributor outlet and an ink inlet of each generator.

15. The printer of claim 14 characterized in that at least part of the pipes are rigid and that the pipes have equal numbers of elbows.

16. The printer of claim 15 characterized in that the value of each elbow angle of a pipe is identical on all the other pipes.

17. The printer of claim 15 characterized in that the elbows of the pipes form right angles.

18. The printer of claim 13 characterized in that the printer comprises several lines of generators aligned side-by-side, the lines being parallel to one another.

19. The generator of claim 10 characterized in that the distance between two end nozzles and two consecutive cavities of the same body is equal to the distance between two consecutive nozzles of the same cavity.

20. The generator of claim 19 characterized in that the generator is equipped with positioning means aligned parallel to the axial direction of the nozzles.

* * * * *

UNITED STATES PATENT AND TRADEMARK OFFICE

CERTIFICATE OF CORRECTION

PATENT NO. : 6,832,826 B2
DATED : December 21, 2004
INVENTOR(S) : Dunand

It is certified that error appears in the above-identified patent and that said Letters Patent is hereby corrected as shown below:

Column 7,
Lines 1 and 22, after "acoustic wave generator", please insert -- 14 --.

Column 14,
Line 42, after "measurement", please delete "1" and insert therefor -- $\ell$ --.
Line 44, please delete "1/4" and insert therefor -- [[1/4]] $\ell$/4 --.
Lines 45, 48 and 63, please delete "1/2" and insert therefor -- $\ell$/2 --.
Lines 45 and 48, please delete "3/4" and insert therefor -- 3 $\ell$/4 --.
Line 52, please delete "1/2" and insert therefor -- [[1/2]] $\ell$/2 --.

Column 15,
Line 24, before "The printer" please delete "Printer".

Signed and Sealed this

Twelfth Day of April, 2005

JON W. DUDAS
*Director of the United States Patent and Trademark Office*